US005379789A

United States Patent [19]

Schneider et al.

[11] Patent Number: 5,379,789

[45] Date of Patent: Jan. 10, 1995

[54] COAXIAL FILTER CIGARETTE

[75] Inventors: Werner Schneider, Quickborn; Bernd-Henrik Müller; Gert Rudolph, both of Hamburg, all of Germany

[73] Assignee: B.A.T. Cigarettenfabriken GmbH, Hamburg, Germany

[21] Appl. No.: 916,685

[22] Filed: Jul. 22, 1992

[30] Foreign Application Priority Data

Aug. 19, 1991 [DE] Germany ..... 4127420

[51] Int. Cl.[6] ..... A24D 1/00; A24D 1/02

[52] U.S. Cl. ..... 131/360; 131/194; 131/364; 131/365

[58] Field of Search ..... 131/331, 341, 344, 360, 131/331, 364, 194, 365

[56] References Cited

U.S. PATENT DOCUMENTS 3,356,094 12/1967 Ellis et al. .
3,614,956 10/1971 Thornton .
4,219,031 8/1980 Rainer et al. .
4,986,287 1/1991 Schneider et al. ..... 131/360

FOREIGN PATENT DOCUMENTS 887.956 2/1962 France .
3602846A1 8/1988 Germany .
3743597C1 2/1989 Germany .
3836210C1 10/1989 Germany .
3901226C1 7/1990 Germany .
1086443 10/1967 United Kingdom .
2070409A 9/1981 United Kingdom .

*Primary Examiner*—Jennifer Bahr
*Attorney, Agent, or Firm*—Armstrong, Westerman, Hattori, McLeland & Naughton

[57] ABSTRACT

In a coaxial cigarette including a rod portion having an inner core of a material smoldering substantially without residue, a sheath for the inner core, an outer jacket coaxially surrounding the inner core and its sheath, a sheath for the outer jacket and a filter portion, even whilst dispensing with special papers provided with special additives the secondary smoke is effected solely by the characteristics of a special coaxial rod type, the packing density of the inner core being greater than the packing density of the outer jacket, the draw resistance per unit length with respect to the packing density being greater in the inner core than in the outer jacket, the air permeability of the sheath of the inner core being less than the air permeability of the sheath of the outer jacket and the filter portion having a filter ventilation degree of at least 30% and a retention degree of at least 40%.

15 Claims, 1 Drawing Sheet

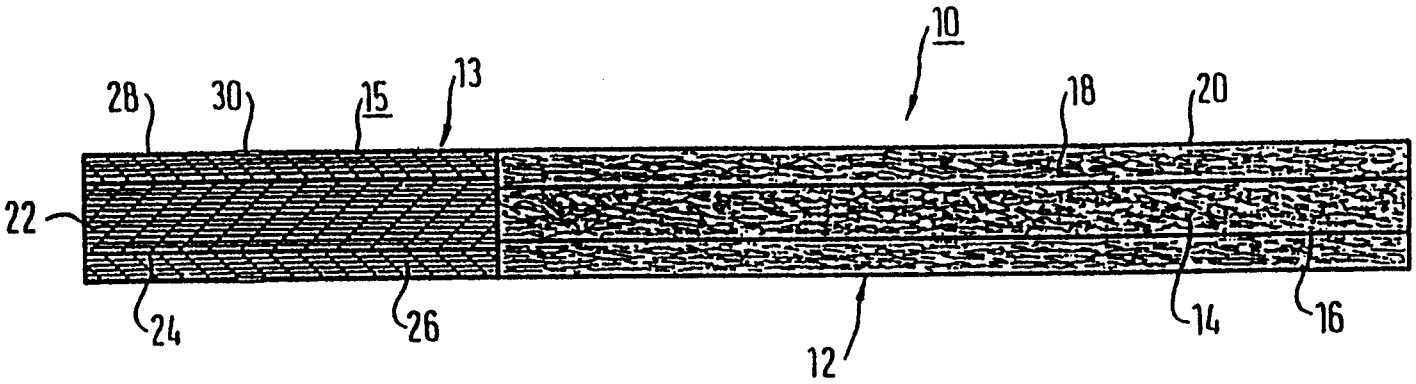
10
12
13
14
15
16
18
20
22
24
26
28
30

COAXIAL FILTER CIGARETTE

BACKGROUND OF THE INVENTION

1. Field of the Invention

The invention relates to a coaxial filter cigarette comprising a rod portion, an inner core of a tobacco and/or non-tobacco material smouldering substantially without residue, a sheath for the inner core, an outer jacket of a tobacco and/or non-tobacco material surrounding the inner core and its sheath, and a sheath for the outer jacket, as well as a filter portion.

2. Description of the Prior Art

A number of publications exist on so-called "coaxial smokable articles", i.e. in particular coaxial cigars or cigarettes having an inner core which is surrounded by a jacket of tobacco material. The basic principle of such a coaxial cigarette is for example known from FR-PS 998,556, the inner core consisting of a tobacco of lower quality which is surrounded by an annular jacket of tobacco of higher quality. This makes it possible to achieve savings with regard to the costs of the tobacco materials employed.

Further embodiments of such coaxial cigarettes are described in FR-PS 1,322,254, U.S. Pat. No. 3,614,956, U.S. Pat. No. 4,219,031, GB-OS 2,070,409, GB-PS 1,086,443 and DE-OS 3,602,846.

Furthermore, from U.S. Pat. No. 3,356,094 a coaxial cigarette is known having an inner hollow tube and an aerosol-generating zone with a narrow outlet; the production of this coaxial cigarette is however very complicated and thus expensive; moreover, the various components are separate from each other and this gives an unusual smoke pattern.

A coaxial filter cigarette of the type indicated is known from DE-PS 3,743,597 and comprises a rod portion and a filter portion; the rod portion includes an inner core of a material smouldering substantially free of residue, in particular tobacco material, a sheath for the inner core, an outer jacket of a tobacco and/or non-tobacco material coaxially surrounding the inner core and its sheath and a sheath for the outer jacket.

The filter portion comprises a filter core, an air-impermeable sheath for the filter core, a filter jacket and a sheath for the filter jacket.

The basic principle of this coaxial filter cigarette resides in that in the radial direction a distinction is made between two regions, i.e. the zone of the main heat source on the one hand and on the other hand the zone in which the major portion of the aerosol reaching the mouth of the smoker is generated. The heat-generating zone is in the outer jacket and the aerosol-generating zone is in the inner core of the rod portion.

A problem with such a design of a coaxial filter cigarette is the desired reduction of the secondary smoke which can only be achieved with great expenditure. Also, such a coaxial filter cigarette has an ignition potential similar to a conventional cigarette.

A further coaxial filter cigarette of this type is known from DE-PS 3,901,226. The latter also comprises a rod and a filter portion, the rod portion including an inner core of a material smouldering substantially free of residue, a substantially air-impermeable sheath, an outer jacket coaxially surrounding the inner core and its sheath and a sheath for the outer jacket. The filter portion is formed as coaxial filter having a filter core surrounded by an air-impermeable sheath and a filter jacket.

The zone required only as heat source and the zone in which the major part of the aerosol reaching the mouth of the smoker is produced are spatially separate. This has the essential effect that the smoke reaching the mouth of the smoker has a high proportion of components relevant to the flavour and a very low proportion of undesirable combustion products. Since the zone generating the heat is arranged in the inner core of the rod portion, the combustion products are shielded by the outer jacket of the rod portion and thereby given off largely via the main smoke and this can be utilized as one of several pre-requisites for the reduction of the secondary smoke.

Since however the mixture in the rod portion as a rule furnishes such large amounts of smoke that the coaxial filter element alone no longer suffices for the filtering, diffusion and ventilation elements are additionally arranged between the filter element and rod portion, possibly with further intermediate elements and outer passages.

A feature common to both the known coaxial cigarettes of this type is that an appreciable secondary smoke reduction can be achieved only by using special papers, in particular by cigarette papers of very low air permeability and with specific additives. However, due to the combustion of these special papers the main smoke then necessarily has an undesirably high content of carbon monoxide which can only be inadequately reduced by the known arrangements. This fact limits the possibility of reducing the secondary smoke.

SUMMARY OF THE INVENTION

The invention therefore has as its object the provision of a coaxial filter cigarette of the category specified in which the aforementioned disadvantages do not occur; in particular a considerable reduction of the secondary smoke is made possible.

The invention therefore proposes in a coaxial filter cigarette comprising a rod portion, an inner core of a tobacco and/or non-tobacco material smouldering substantially without residue, a sheath for the inner core, an outer jacket of a tobacco and/or non-tobacco material surrounding the inner core and its sheath, and a sheath for the outer jacket, as well as a filter portion, the improvement in which the inner core has a diameter of 45 to 80% of the outer diameter of the filter cigarette, the packing density of the inner core is greater than the packing density of the outer jacket, the draw resistance per unit length with respect to the packing density is greater in the inner core than in the outer jacket, the air permeability of the sheath of the inner core is less than the air permeability of the sheath of the outer jacket, and the filter portion has a filter ventilation degree of at least 30% and a retention degree of at least 40%.

Expedient embodiments are defined by the features of the subsidiary claims.

The advantages achieved with the invention are due to the fact that a greater proportion of the smoke forming is conducted into the main smoke than with known coaxial versions and with normal rods. Thus, even when using a conventional cigarette paper a greater proportion of the smoke normally getting into the secondary smoke on formation is deflected into the main smoke and thereafter a filtration of the increased main smoke component is carried out by a correspondingly more effective filter.

Irrespective of whether the zone of main heat generation is arranged in the inner core or in the outer jacket and accordingly the zone of the aerosol generation in the outer jacket or the inner core, in contrast to the known steps a smoke redistribution from the secondary smoke to the main smoke is ensured solely by the configurations of the specific coaxial rod type. It is possible here to dispense with special cigarette papers, in particular cigarette papers of very low air permeability and with additives for reducing the secondary smoke, thereby also avoiding the resulting increase of the carbon monoxide content in the main smoke.

Finally, with the structure of the coaxial filter cigarette according to the invention not only the quantity but also the quality of the secondary smoke can be controlled. This control is largely independent from the mixture governing the quality of the main smoke, in a manner not possible with hitherto known solutions for reducing secondary smoke.

For example, in the selection of the peripheral tobacco the emphasis can preferably be on the minimizing of precursors for irritating smoke ingredients.

BRIEF DESCRIPTION OF THE DRAWINGS

The invention will be explained hereinafter with the aid of examples of embodiment with reference to the attached schematic drawing, the single FIGURE of which illustrates an axial section through a coaxial filter cigarette.

DESCRIPTION OF THE PREFERRED EMBODIMENTS

The coaxial filter cigarette shown in FIG. 1 and indicated generally by the reference numeral 10 comprises a rod portion 12 to which a coaxial filter portion 13 is attached by the usual production techniques. The rod portion 12 includes an inner core 14 having a sheath 16 and an outer jacket 18 with a sheath 20.

The filter portion 13 comprises a coaxial filter element 15 consisting of a filter core 22 with a sheath 24 and a filter jacket 26 with a sheath 28.

The coaxial filter element 15 may be ventilated. The ventilating means is indicated as a line of punctiform ventilation openings 30 which extend over the periphery of the coaxial filter element also through the covering paper, which is not illustrated.

The coaxial rod portion serves to generate smoke and has a length of 25 to 85 mm and a diameter of 7 to 9 mm, i.e. the usual dimensions of conventional cigarettes.

The inner core 14 of the rod portion has a diameter of 40 to 80%, preferably 60 to 70%, of the outer diameter of the cigarette. The material of the inner core 14 is provided with a packing density of 190 to 250 mg/cm$^3$, preferably 210 to 230 mg/cm$^3$. As required, additives are added to the material of the inner core 14 to control the combustion. The material of the inner core is such that the draw resistance per unit length, with respect to the packing density, is 0.09 to 0.15, preferably 0.1 to 0.12 (mm Wc) cm$^2$/mg.

The sheath 16 of the inner core of the rod portion 12 consists of paper, a foil of tobacco material or another suitable material. Its air permeability lies beneath 30 ISO units, preferably beneath 10 ISO units.

The outer jacket 18 coaxially surrounds the inner core and its sheath 16. The material of the outer jacket 18 is provided with a packing density of 140 to 200 mg/cm$^3$, preferably 150 to 180 mg/cm$^3$. The ratio of the draw resistance per unit length to the packing density is 0.035 to 0.08, preferably 0.04 to 0.05 (mm Wc) cm$^2$/mg.

The sheath 20 of the outer jacket 18 of the rod portion 12 has an air permeability of less than 40 ISO units, preferably 15 to 25 ISO units; it consists of a cigarette paper, which may be a standard paper. Special papers may also be employed for reducing the secondary smoke. The sheath 20 of the outer jacket 18 possibly contains additives for controlling the combustion.

The outer sheath 20 of the outer jacket 18 of the rod portion 12 may possibly be provided with segment perforations for controlling the temperature gradient in the outer jacket 18; the use and/or the configuration of said segment perforations depends on the other materials used.

Similar to the rod portion 12, the coaxial filter 15 consists of a filter core 22 having a sheath 24 and a filter jacket 26 having a sheath 28.

In a first example of embodiment the inner core 14 is filled with so-called fillers, i.e. with filling tobaccos, as a rule of lesser quality, and/or ribs. Tobacco sheets are also suitable. The sheath 16 of the inner core 14 is a paper or tobacco sheet with the air permeability described.

The outer jacket 18 consists of aroma-rich tobaccos which are substantially responsible for the generation of the aerosol relevant to the flavour. Otherwise, the configuration features described above apply.

The filter core 22 has a diameter which is up to 2 mm greater than the diameter of the rod inner core and with ventilation degrees of 30 to 80% of the filter has a retention degree in the filter core of over 90%, preferably over 95%. Consequently, the main smoke is filtered in advantageous manner. In contrast, the filter jacket 26 has a retention degree of less than 30% so that the filtering of the aerosol relevant to the flavour is less and this gives a positive flavour. The retention degrees relate to the total mass of the nicotine-free dry condensate flowing into the respective filter zone.

As materials for the two filter zones, i.e. the filter core 22 and the filter jacket 26, the usual filter materials can be used as employed at present in the cigarette industry.

In a second example of embodiment the inner core consists of aroma-rich tobaccos whilst the outer jacket 18 of the tobacco rod 12 contains filling tobaccos, ribs or tobacco sheet. For this purpose for example flue-cured tobaccos of lower leaf levels may be employed. The filter 15 is then configured so that the filter core 22 has a smaller diameter than the inner core 14 and a retention degree of less than 30%. The outer core accordingly has a retention degree of more than 90%.

The effect of the invention compared with conventional cigarettes will be explained with the aid of an example. In the example, a coaxial cigarette made in accordance with the above specifications in a filterless form was compared with a normal filterless cigarette. This was because the invention is not primarily concerned with filter effects but a specific coaxial structure in the rod portion by which the redistribution from secondary smoke to main smoke is implemented. The following specifications were observed and the following values measured:

| Specifications | Cigarette according to the invention | Comparison cigarette |
|---|---|---|

-continued

| | | |
|---|---|---|
| Rod structure | coaxial | normal |
| Rod diameter (mm) | 7.94 | 7.91 |
| Rod length (mm) | 84 | 84 |
| Core diameter (mm) | 5.4 | — |
| Tobacco mixture (mass proportions with respect to the total mass of the mixture/cigarette | outer jacket: 43% Burley | as in the cigarette according to the invention |
| | inner core: 57% flue-cured Filler | but mixture distributed homogeneously in the rod |
| Packing density (mg/cm$^3$) | | 188 |
| Inner core: | 230 | (for total volume) |
| Outer jacket: | 150 | |
| Total mass (mg) | 778 | 778 |
| Ratio (draw resistance/unit length)/packing density ((mm Wc)cm$^2$/mg) | | |
| Inner core: | 0.1 | |
| Outer jacket: | 0.047 | |
| Air permeability of the | | |
| outer sheath | 24 | 24 |
| inner sheath (ISO units) | 0 | |

| Results: | according to the invention | comparison cigarette |
|---|---|---|
| Ratio main smoke/secondary smoke condensate (PMWNF) | 1.4 | 1.0 |
| Secondary smoke condensate (PMWNF) | 25 | 31 |
| Carbon monoxide in the main smoke (ml) | 21 | 20 |

The main smoke condensate is usually determined in accordance with the smoking standard whilst the secondary smoke is collected during the smoking and the condensate determined. The determined values show that with substantially the same total smoke condensate, i.e. comprising main and secondary smoke, the secondary smoke condensate of the cigarette according to the invention is found to be about 20% less than that of the comparison sample. The ratio of main smoke to secondary smoke condensate increases from 1.0 for the conventional comparative sample to 1.4 for the cigarette according to the invention. Nevertheless, the total volume of CO determined after the smoking remains practically the same, being 21 compared with 20 ml in the main smoke.

Although coaxial filters with the specifications indicated are particularly preferred, known ventilated mouthpieces or filters are also suitable for use with the tobacco rods specified above, permitting a filter ventilation degree of at least 40% and leading to a retention degree of at least 40% (with respect to the total mass of the nicotine-free dry condensate flowing into the filter).

I claim:

1. A coaxial filter cigarette, comprising a) a rod portion, a1) an inner core of a tobacco material smoldering substantially without residue provided within the rod portion, a2) a sheath for the inner core, a3) an outer jacket of a tobacco material surrounding the inner core and its sheath, and a4) a sheath for the outer jacket, as well as b) a filter portion, wherein c) the inner core has a diameter of 45 to 80% of the outer diameter of the filter cigarette, d) the packing density of the inner core is greater than the packing density of the outer jacket, the packing density of the inner core being 190 to 250 mg/cm$^3$, e) the draw resistance per unit length with respect to the packing density is greater in the inner core than in the outer jacket, and is 0.09 to 0.15 (mm Wc) cm$^2$/mg in the inner core, f) the air permeability of the sheath of the inner core is less than the air permeability of the sheath of the outer jacket, and g) the filter portion has a filter ventilation degree of at least 30% and a retention degree of at least 40%.

2. A coaxial filter cigarette according to claim 1, wherein the inner core of the rod portion contains additives for controlling the thermal processes.

3. A coaxial filter cigarette according to claim 1, wherein the sheath of the inner core has an air permeability of less than 30 ISO units.

4. A coaxial filter cigarette according to claim 1, wherein the packing density of the outer jacket is 140 to 200 mg/cm$^3$.

5. A coaxial filter cigarette according to claim 1, wherein the draw resistance per unit length, with respect to the packing density, is 0.035 to 0.08 (mm Wc) cm$^2$/mg in the outer jacket.

6. A coaxial filter cigarette according to claim 1, wherein the outer jacket of the rod portion contains additives for controlling the thermal processes.

7. A coaxial filter cigarette according to claim 1, wherein the sheath of the outer jacket has an air permeability of less than 40 ISO units.

8. A coaxial filter cigarette according to claim 1, wherein the sheath of the outer jacket of the rod portion contains additives for controlling the thermal processes.

9. A coaxial filter cigarette according to claim 1, wherein a coaxial filter portion is provided having a filter core, a diameter of the filter core corresponds substantially to the diameter of the inner core of the rod portion, and a filter jacket.

10. A coaxial filter cigarette according to claim 1, wherein the inner core consists of aroma-rich tobaccos and the outer jacket of fillers.

11. A coaxial filter cigarette according to claim 9, wherein with ventilation degrees of 30 to 80% the filter portion leads respectively to retention degrees of less than 30% in the filter core and more than 90% in the filter jacket.

12. A coaxial filter cigarette according to claim 9, wherein the diameter of the filter core is somewhat less than the diameter of the inner core.

13. A coaxial filter cigarette according to claim 1, wherein the inner core consists of fillers and the outer jacket of aroma-rich tobaccos.

14. A coaxial filter cigarette according to claim 13, wherein with ventilation degrees of 30 to 80% the filter portion leads respectively to retention degrees of more than 90% in the filter core and less than 30% in the filter jacket.

15. A coaxial cigarette according to claim 14, wherein the filter portion comprises a filter core with a diameter somewhat greater than the diameter of the inner core.

* * * * *